United States Patent [19]

Ouchi

[11] 3,942,858

[45] Mar. 9, 1976

[54] LAMP SOCKET

[75] Inventor: Teruo Ouchi, Hachiouji, Japan

[73] Assignee: Olympus Optical Co., Ltd., Tokyo, Japan

[22] Filed: Feb. 14, 1974

[21] Appl. No.: 442,627

[30] Foreign Application Priority Data

Feb. 16, 1973 Japan ..... 48-20287
Feb. 16, 1973 Japan ..... 48-20288

[52] U.S. Cl. ..... 339/75 R; 339/176 L; 339/254 R; 339/273 S

[51] Int. Cl.[2] ..... H01R 13/54

[58] Field of Search ..... 339/176 L, 253 R, 254 R, 339/17, 74 L, 266 R, 273 S, 274, 91 L, 54, 75 R, 75 T, 253 S, 255 R

[56] References Cited

UNITED STATES PATENTS

| | | | |
|---|---|---|---|
| 2,175,883 | 10/1939 | DeReamer | 339/75 T |
| 2,499,507 | 3/1950 | Jordan | 339/54 |
| 2,638,574 | 5/1953 | Webb | 339/254 M |
| 2,702,377 | 2/1955 | Dahlhaus et al. | 339/54 X |
| 2,774,050 | 12/1956 | Logan | 339/253 S X |
| 2,799,009 | 7/1957 | Benander | 339/75 R |
| 3,579,283 | 5/1971 | Welburn | 339/274 X |
| 3,614,710 | 10/1971 | Glickmann | 339/255 R X |

*Primary Examiner*—Gerald A. Dost
*Assistant Examiner*—E. F. Desmond
*Attorney, Agent, or Firm*—Cushman, Darby & Cushman

[57] ABSTRACT

A lamp socket arranged to facilitate inserting of base pins of a lamp and to securely hold said pins after inserting by providing fixing members having holes for inserting said base pins and pushing members for fixing said base pins.

2 Claims, 5 Drawing Figures

LAMP SOCKET

BACKGROUND OF THE INVENTION a. Field of the invention:

The present invention relates to a lamp socket and, more particularly, to a lamp socket for a lamp with a bipin type base.

b. Description of the prior art:

Conventional lamp sockets widely used for lamps with the bipin type base are of such type that the lamp is mounted by pushing base pins of the lamp into spaces between plate springs. As, however, strength of the base pin mounting portion of base pins of the bipin type base is low, it is impossible to increase the elastic pressure of plate springs and, consequently, it is impossible to make the contact resistance small. As the contact resistance thus becomes necessarily large, heat generation is also large. Because of such heat generation, base pins and plate springs cause oxidization and they tend to cause poor contact. Furthermore, because of the fact that the lamp is mounted by inserting base pins into spaces between plate springs though the elastic pressure is low, the mounting operation is difficult and, therefore, the lamp cannot be mounted or dismounted easily. Thus, conventional lamp sockets for said lamps have various disadvanatages.

SUMMARY OF THE INVENTION

It is, therefore, the principal object of the present invention to provide a lamp socket for a lamp with a bipin type base arranged to push open holes for inserting base pins, which are formed in fixing members mounted to the lamp socket, resisting against spring force, said base pins being mounted to said fixing member by spring force after inserting said base pins.

Another object of the present invention is to provide a lamp socket for a lamp with a bipin type base comprising a fixing member having slots mounted to the lamp socket and levers rotatably mounted to said fixing members by their ends on one side which are inserted into said slots of said fixing members and urged in pre-determined direction by springs, said base pins being mounted to the lamp socket by means of said lever.

Still another object of the present invention is to provide a lamp socket for a lamp with a bipin type base comprising fixing members having holes and mounted to the lamp socket and slide members slidably fitted to said fixing member and urged in pre-determined direction by means of springs, base pins of the lamp being inserted into said holes and then fixed by force of said springs.

DETAILED DESCRIPTION OF THE PREFERRED EMBODIMENTS

Figure 1:
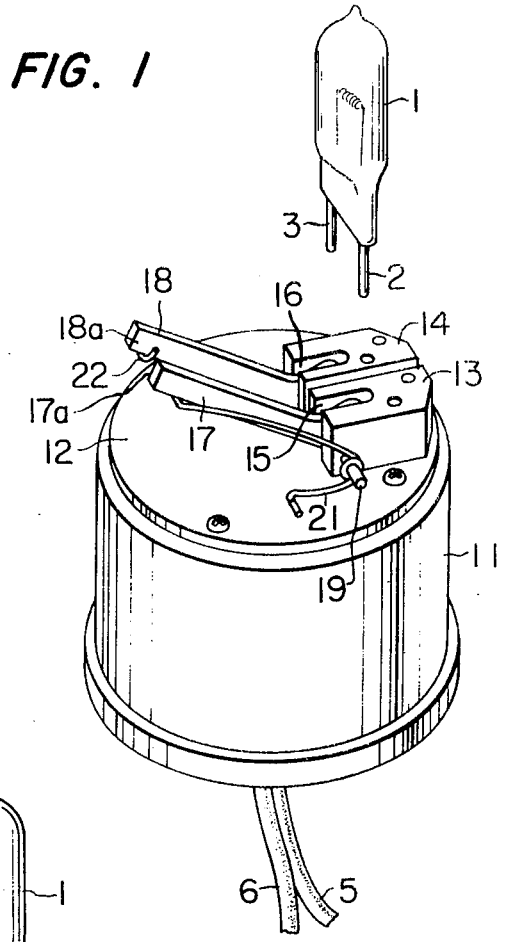
FIG. 1 shows a perspective view illustrating a first embodiment of the present invention.
Figure 2:
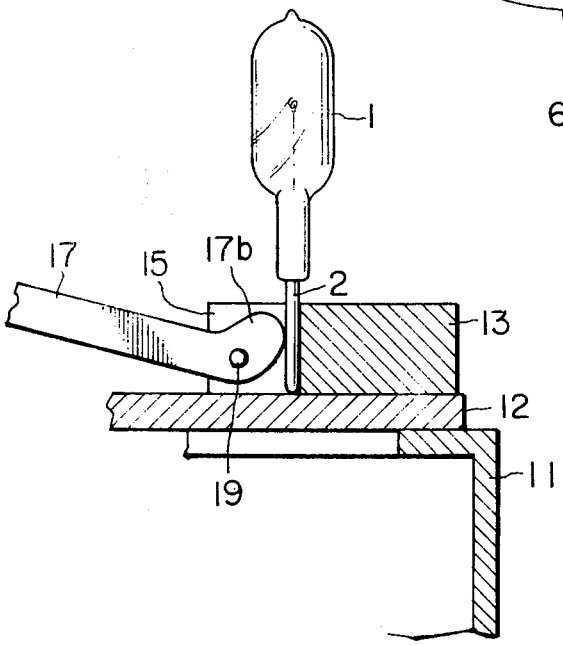
FIG. 2 shows a sectional view of the fixing member of said first embodiment.

Referring to embodiments illustrated on accompanying drawings, concrete contents of the present invention are described below. In FIG. 1, which shows a first embodiment, numeral 1 designates a lamp with a bipin type base, numerals 2 and 3 respectively designate base pins of the lamp 1 and numeral 11 designates a lamp socket body which is used by mounting, for example, to a microscope. Numeral 12 designates an insulating plate mounted on the top surface of the lamp socket body 11. Numerals 13 and 14 designate a pair of fixing members fixed on the surface of the insulating plate 12 and made of electrically conductive material, said fixing members 13 and 14 being respectively connected to cords 5 and 6. Said fixing members 13 and 14 respectively have slots 15 and 16. Numeral 17 and 18 designate levers respectively inserted into slots 15 and 16 formed in fixing members 13 and 14 and are pivotably mounted to a pin 19 which is mounted passing through said fixing members 13 and 14. Numerals 21 and 22 designate springs respectively wound around both ends of said pin 19. Ends of said springs 21 and 22 on one side are respectively hooked to ends of levers 17 and 18 and the other ends of said springs 21 and 22 are respectively arranged to push the surface of the insulating plate by their spring forces. Consequently, ends of levers 17 and 18 are always kept pushed up by forces of respective springs 21 and 22. FIG. 2 shows a sectional view of the fixing member which is taken in the direction along its slot. (As fixing members 13 and 14 have the substantially same construction, FIG. 2 shows only one of them.) As it is evident from FIG. 2, the pivoted end **17*b* of the lever 17 is bent upward. At the innermost portion of the slot 15 formed in the fixing member 13, a space is provided between the bent end portion 17*b* of the lever 17 and the fixing member 13, and it is so arranged that this space becomes wide when the free end 17*a* of the lever 17 is pushed down and becomes narrow when the free end 17*a* of the lever 17** is pushed up.

Function of the first embodiment of the present invention having the construction as described in the above is as described below. To mount the lamp 1 to the lamp socket, free ends **17*a* and 18*a* of levers 17 and 18 are first pushed down together by a finger. Thus, bent portions 17*b* and 18*b* at pivoted ends of levers 17 and 18 move upward, spaces formed between said bent portions and innermost portions of slots 15 and 16 of fixing members 13 and 14 become wide and base pins 2 and 3 of the lamp 1 can be easily inserted into those spaces. When base pins 2 and 3 are completely inserted, the finger which is pushing levers 17 and 18 is released from those levers. Thus, free ends 17*a* and 18*a* of levers 17 and 18 are pushed up by forces of springs 21 and 22 and, consequently, bent portions 17*b* and 18*b* at pivoted ends of those levers are moved downward and said spaces become narrow. In other words, bent portions 17*b* and 18*b* of levers 17 and 18 push base pins 2 and 3, which are inserted to said spaces against innermost portions of slots 15 and 16 of fixing members 13 and 14 and fix those base pins 2 and 3**.

As explained in the above, the lamp socket according to the above embodiment of the present invention allows to mount and dismount the lamp after making spaces between bent end portions of levers and innermost portions of slots wide enough for easily inserting base pins by pushing those levers down. Therefore, the lamp can be mounted and dismounted quite easily. Moreover, when levers which are pushed down are released after inserting base pins, levers are pushed up and base pins are powerfully pushed by bent portions of levers against innermost portions of slots. As a result, the lamp is held firmly and the contact resistance becomes small.

Figure 3:
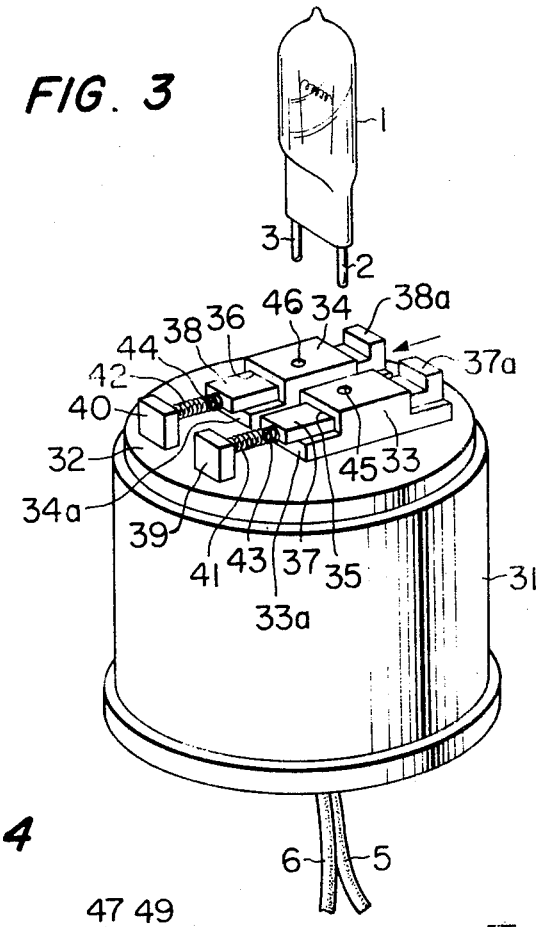
FIG. 3 shows a perspective view illustrating a second embodiment of the present invention.

Now, a second embodiment of the lamp socket according to the present invention is described below. In FIG. 3, numeral 31 designates a lamp socket body and numeral 32 designates a insulating plate which are same as the lamp socket body 11 and insulating plate 12 of the first embodiment. Numerals 33 and 34 designate fixing members made of electrically conductive material and fixed on the surface of the insulating plate 32. These fixing members 33 and 34 respectively have guide holes 35 and 36. To said guide holes 35 and 36, slide members 37 and 38 are respectively fitted so that slide members 37 and 38 can be slided along guide holes 35 and 36. Numerals 39 and 40 respectively designate support members fixed on the surface of the insulating plate 32. Numerals 41 and 42 respectively designate compression coil springs, ends thereof on one side are respectively fixed by set screws 43 and 44, which are mounted to end faces of slide members 37 and 38 on one side. The other ends of said compression coil springs 41 and 42 are respectively fixed to support members 39 and 40. By these compression coil springs 41 and 42, slide members 37 and 38 are respectively kept pushed in one direction. Besides, set screws 43 and 44 respectively contact end faces 33*a* and 34*a* of fixing members 33 and 34, when slide members 37 and 38 are moved by forces of said compression coil springs 41 and 42, and serve to prevent further movement of slide members 37 and 38.

Figure 4:
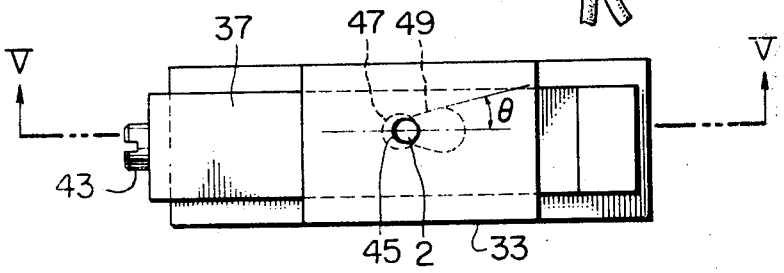
FIG. 4 shows a plan view of the fixing member of said second embodiment.
Figure 5:
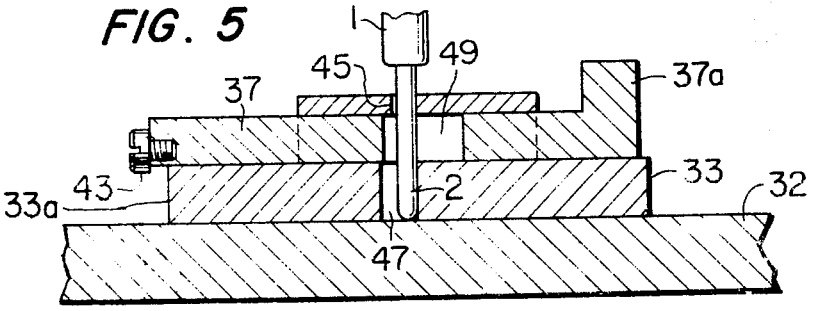
FIG. 5 shows a sectional view of the fixing member of said second embodiment taken along the line V-V in FIG. 4.

In FIG. 4 and FIG. 5, the fixing member 33 and its related component parts are shown by enlarging. (As the fixing member 34 has the same construction as that of the fixing member 33, these figures show the fixing member 33 only.) FIG. 4 shows a plan view of the fixing member 33 and FIG. 5 shows a sectional view taken along the line V—V in FIG. 4. In these figures, numeral 45 designates a hole which is provided in the upper part of the fixing member 33 and to which the base pin 2 of the lamp 1 is to be inserted. Numeral 47 designates a hole formed in the lower part of the fixing member 33 and having a diameter larger than that of the hole 45. Numeral 49 designates a hole formed in the slide member 37. Said hole 49 has a sector-like shape, that is, it radius of arc at the portion near the projecting portion 37*a* of the slide member 37 is larger and its radius of arc at the portion on the other side is smaller.

In the following, the function of the lamp socket according to the second embodiment is described. To mount the lamp to the lamp socket, projecting portions 37*a* and 38*a* of slide members 37 and 38 are pushed together by a finger to move slide members 37 and 38 in the direction shown by the arrowhead by compressing compression coil springs 41 and 42. When projecting portions 37*a* and 38*a* finally contact upper portions of fixing members 33 and 34, slide members 37 and 38 stop. In that position, the hole 45 is aligned with portion of larger radius of arc of the hole 49 as it is evident from FIG. 4 and FIG. 5. Therefore, base pins 2 and 3 of the lamp 1 are inserted easily. (As already described, the fixing member 34 and its related component parts have the same construction as the fixing member 33 and its related component parts. Therefore, both of base pins 2 and 3 can be inserted smoothly into corresponding holes provided to respective fixing members.) When the finger which is pushing projecting portions 37*a* and 38*a* is then released, slide members 37 and 38 are respectively pushed back in the direction opposite to the arrowhead by forces of compression coil springs 41 and 42. Because of the fact that the hole 49 provided to this slide member 37 is of the sector-like shape (the hole provided to the slide member 38 is also of the same shape), the portion of the smaller radius of arc of the hole 49 comes to the position of the hole 45 formed in the upper part of the fixing member 33 by the above-mentioned movement of the slide member 37. Consequently, the pin 2 is pushed by this portion of the hole 49 having the smaller radius of arc against walls on one side of holes 45 and 47 of the fixing member 33. (The above-mentioned actions are taken place in the same way also for the fixing member 34 and slide member 38.) Therefore, base pins 2 and 3 of the lamp 1 which are inserted are held by walls of holes provided to upper and lower portions of both fixing members and wedge-like portions of holes, which have smaller radius of arc, of both slide members. Furthermore, as base pins are clamped by wedge-like portions of holes, the clamping forces become larger than forces given by springs and the lamp is fixed firmly. That is, when the half angle of the hole 49 is represented by reference symbol $\theta$ (refer to FIG. 4) and force of the compression coil spring is represented by reference symbol F, the force N which is applied to each of base pins 2 and 3 becomes $$N = \frac{F}{2 \sin \theta}$$

according to the theory of wedge. If, for example, $\theta = 15°$, it becomes $N = 2F$, and base pins 2 and 3 are respectively pushed by forces which are twice the force F of each compression coil spring. Therefore, even when the spring force is made weak, base pins are clamped by large forces and operation of slide members 37 and 38 is very easy.

To dismount the lamp 1, projecting portions 37a and 38a of slide members 37 and 38 are pushed by a finger in the direction shown by the arrowhead and slide members 37 and 38 are moved by compressing compression coil springs 41 and 42 until projecting portions 37*a* and 38*a* contact fixing members 33 and 34. By this operation, portions of larger radius of arc of holes 49 formed in slide members 37 and 38 move to positions where they are aligned with holes 45 and 47, thus clamping of base pins 2 and 3 is released. Therefore, base pins 2 and 3 can be pulled out quite easily.

In the above-mentioned second embodiment, holes 49 provided to slide members are of the sector-like shape. However, the shape of holes is not limited to that shape but it is possible to adopt any shape which provides an action equivalent to the above. That is, any shape can be adopted provided that at least one side surface of the hole is arranged at an angle against the moving direction of the slide member.

As explained in the above, for to the second embodiment, base pins can be inserted quite easily because they are inserted to portions of larger radius of arc of holes in slide members by pushing those slide members against spring forces. Besides, when the force for pushing slide members is released after inserting, base pins are fixed by spring forces. Therefore, the lamp can be mounted very easily and held with high reliability. Further, when holes in slide members are formed in the sector-like shape or the like, forces to clamp base pins become large even when spring forces are weak, and the lamp can be held with still higher reliability.

I claim:

1. A lamp socket having a body comprising:

at least one fixing member mounted on said body having groove means for receiving the base pins of a lamp with said base pins each having a longitudinal axis;

at least one pushing member having at least one lever arm and an end portion inserted in said groove means, said pushing member being pivotally mounted, adjacent to said fixing member, about an axis which extends substantially prependicular to the longitudinal axis of the base pins, spring means mounted on said fixing member, said spring means normally biasing said pushing member against the base pins of a lamp inserted in said groove means to thereby bias the base pins against said fixing member with said spring means applying a force to said pushing member in a generally longitudinal direction relative to the axes of the base pins, said pushing member being releasable from biasing the base pins against said fixing member when said pushing member is displaced a predetermined distance against the applied force of said spring means to thereby permit a substantially resistance free insertion of the base pins within the said groove means in a substantially resistance free removal of the base pins from said groove means.

2. A lamp socket having a body comprising:

at least one fixing member mounted on said body having aperture means for receiving base pins of a lamp, said fixing member also having at least one guide hole;

at least one pushing member slidably disposed within said guide hole of said fixing member, said pushing member having spring means and wedge hole means for holding the base pins, said wedge hole means having at least one side portion thereof formed as a surface inclined with respect to the moving direction of said pushing member, said spring means normally biasing said pushing member against base pins of a lamp inserted in said aperture means to thereby bias the base pins against said fixing member, said spring means applying a force to said pushing member in a predetermined direction, said pushing member being releasable from biasing the base pins against said fixing member when said pushing member is displaced a predetermined distance against the applied force of said spring means to thereby permit a substantially resistance free insertion of the base pins within said aperture means and a substantially resistance free removal of the base pins from said aperture means.

* * * * *